United States Patent [19]

Frady et al.

[11] 4,391,067

[45] Jul. 5, 1983

[54] LOG WALL CONSTRUCTION FOR LOG HOME

[75] Inventors: Dale A. Frady; David C. Frady, both of Waynesville, N.C.

[73] Assignee: Frontier Homes, Inc., Waynesville, N.C.

[21] Appl. No.: 140,240

[22] Filed: Apr. 14, 1980

[51] Int. Cl.[3] ..... E04B 1/10; E04B 1/78

[52] U.S. Cl. ..... 52/97; 52/233; 52/454; 52/309.12

[58] Field of Search ..... 52/443, 233, 417, 438, 52/314, 316, 744, 747, 555, 513, 385, 391, 454, 97

[56] References Cited

U.S. PATENT DOCUMENTS

| | | | |
|---|---|---|---|
| 506,062 | 10/1893 | Myers | 52/443 |
| 1,996,735 | 4/1935 | King | 52/233 |
| 2,130,743 | 9/1938 | Parsons | 52/747 |
| 3,163,890 | 1/1965 | Pichon | 52/233 |
| 3,815,308 | 6/1974 | Corey | 52/391 |

*Primary Examiner*—John E. Murtagh

*Attorney, Agent, or Firm*—Bell, Seltzer, Park & Gibson

[57] ABSTRACT

This invention relates to a wall construction for a log building constructed of a plurality of logs arranged generally parallel one above another. The upper side of each log includes a longitudinally extending, generally vertical abutment surface located between the inner and outer sides of the log and a longitudinally extending inclined surface portion adjoining the abutment surface and sloping downwardly therefrom toward and adjoining the outer side of the log. Respective longitudinally extending filler panels are located between the upper side of each log and the lower side of the next higher log, with the filler panels being positioned against the vertically extending abutment surface on the upper side of the log for filling any longitudinal spaces between adjacent logs. A hardenable filler material is located between the upper side of each log and the lower side of the next higher log and covering the outer side of the filler panel located therebetween to provide a seal between adjacent logs to prevent the passage of water and air through the wall.

24 Claims, 13 Drawing Figures

LOG WALL CONSTRUCTION FOR LOG HOME

FIELD OF THE INVENTION

This invention relates to a building construction and particularly to a wall construction for log buildings.

BACKGROUND OF THE INVENTION

Log homes are currently experiencing a resurgence in popularity. Factors contributing to the appeal for this type of building construction include the simplicity of their design, low maintenance and durability, and economy of construction.

The log cabins built by the early settlers used logs, either rounded or hand hewn into a squared configuration, and stacked one above another with a dovetail or notched joint at the corners of the building. The spaces between adjacent logs were filled with a chinking material, usually clay or mud.

The log homes of today are much more finished and sophisticated than those of the early settlers. While today's log homes still use whole logs stacked one above another, improvements have been made in the way the spaces between adjacent logs are sealed. One known arrangement involves forming notches in the upper and lower sides of the logs and positioning splines in the notches, with caulking or other sealant materials being also positioned between the logs to form a water-tight and air-tight joint.

However, problems still exist in achieving a log wall construction which will remain water-tight and air-tight over a period of time. When settlement of the building or shrinkage of the logs occurs, the above-described notch and spline joint construction has a tendency to open up and allow water to enter the wall, thus requiring periodic recaulking or resealing. Additionally, the notch on the upper side of the logs has a tendency to hold water, and to thus provide conditions conducive to rotting and decaying of the wood.

OBJECTS AND SUMMARY OF THE INVENTION

With the foregoing in mind, it is an important object of the present invention to provide a log wall construction having an improved joint between adjacent logs exhibiting highly durable sealing characteristics against water and wind.

It is a further object of this invention to provide a log wall construction having these characteristics which can be constructed in an efficient and economical manner.

It is still another object of this invention to provide a log wall construction having improved insulating qualities as compared to the conventional types of log wall construction.

These and other objects of this invention are achieved in the log wall construction of this invention wherein the logs are of a particular cross-sectional configuration as defined more fully herein, and wherein a filler panel and a hardenable filler material are positioned between adjacent logs for filling any longitudinal spaces between the logs.

The building wall of the present invention comprises a plurality of logs arranged generally parallel, one above another. The logs have respective inner and outer sides and respective upper and lower sides positioned in opposing relation to the adjacent upper and lower sides of other logs. The upper side of each log includes a longitudinally extending vertical abutment surface located between the inner and outer sides of the log and a longitudinally extending surface adjoining the abutment surface and extending laterally therefrom toward the outer side of the log. Respective longitudinally extending filler panels are located between the upper side of each log and the lower side of the next higher log. These filler panels are positioned against the vertically extending abutment surface on the upper side of the log for filling any longitudinal spaces between adjacent logs. A hardenable filler material is located between the upper side of each log and the lower side of the next higher log and covering the outer side of the filler panel located therebetween to thus provide a seal between adjacent logs to prevent the passage of water and air through the wall.

Preferably, the lower side of each log also includes a longitudinally extending generally vertical abutment surface located between the inner and outer sides of the log, and the respective filler panels are positioned against the vertical abutment surface on both the lower and upper sides of the log. The abutment surfaces thus serve to hold the filler panels in position, while overlapping the upper and lower edges of the filler panels to assure that all spaces or gaps between adjacent logs are filled. The filler panels are held tightly in place against the vertical abutment surface by suitable means, such as by nails. Preferably, the filler panels are formed of a foamed insulating material to provide enhanced insulating properties in the joint area between adjacent logs.

The log wall construction of this invention is applicable both to hewn logs of a generally squared cross-sectional configuration, and to unhewn or rounded logs having generally rounded outer and inner sides.

In one form of traditional log wall construction, the logs are joined together with a dovetailed notch at the corners of the building to create tight, sturdy joints between adjacent logs. This dovetail construction is most commonly used with squared, hewn logs. In such an arrangement the dovetail corners cause the upper and lower sides of adjacent logs to be positioned in spaced-apart, noncontacting relationship. In other traditional log cabin constructions, the logs are notched in such a way that the upper and lower sides of adjacent logs come into contacting relationship with one another. In both types of construction some type of filler or chinking material is used to fill in any gaps or cracks between adjacent logs. The improved log wall construction of the present invention is applicable to both types of construction, i.e. where the logs are in spaced, noncontacting relationship as well as in walls were the logs are in contacting relationship.

BRIEF DESCRIPTION OF THE DRAWINGS

Some of the objects, features and advantages of the invention having been stated, others will appear as the description proceeds when taken in connection with the accompanying drawings, in which.

DESCRIPTION OF THE ILLUSTRATED EMBODIMENTS

Figure 1:
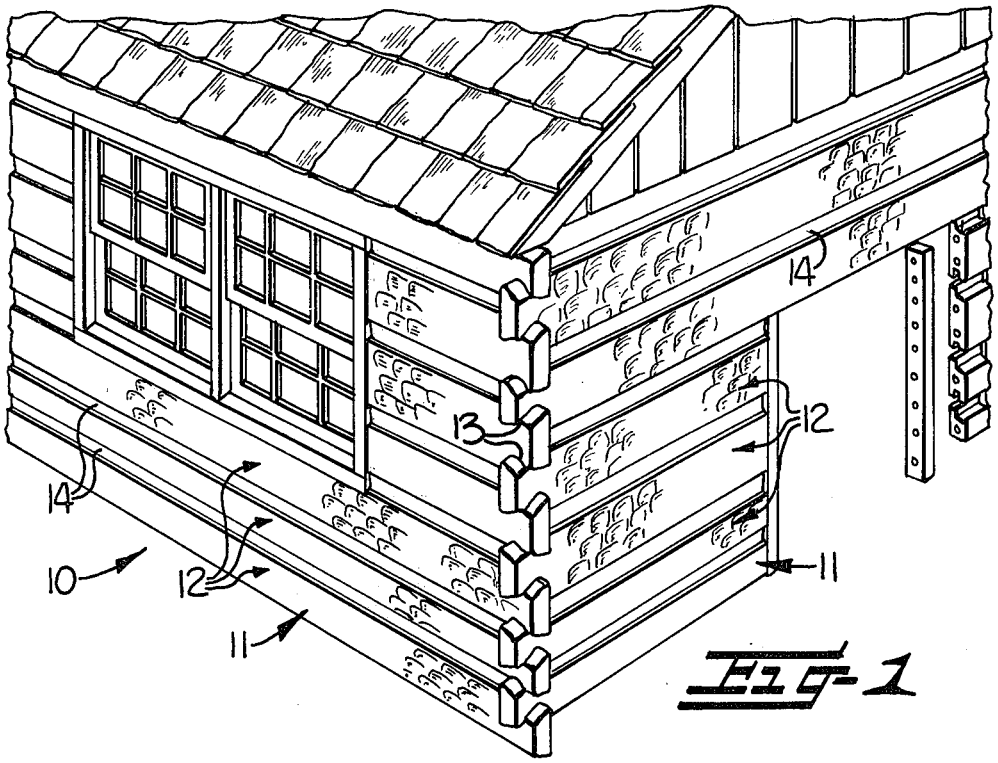
FIG. 1 is a perspective view of a log building having a wall construction in accordance with this invention.

Referring now more particularly to the drawings, there is illustrated in FIG. 1 a log building, generally indicated at 10, having a wall construction in accordance with this invention. As illustrated, the walls 11 of the building are comprised of a plurality of logs 12 arranged generally parallel, one above another. The ends of the logs are notched to form a dovetail joint 13 at the corners of the building. The longitudinal spaces between adjacent logs 12 are filled in a manner to be described more fully herein, with a hardenable chinking material 14 serving to form an airtight and watertight seal between adjacent logs 12.

Figure 2:
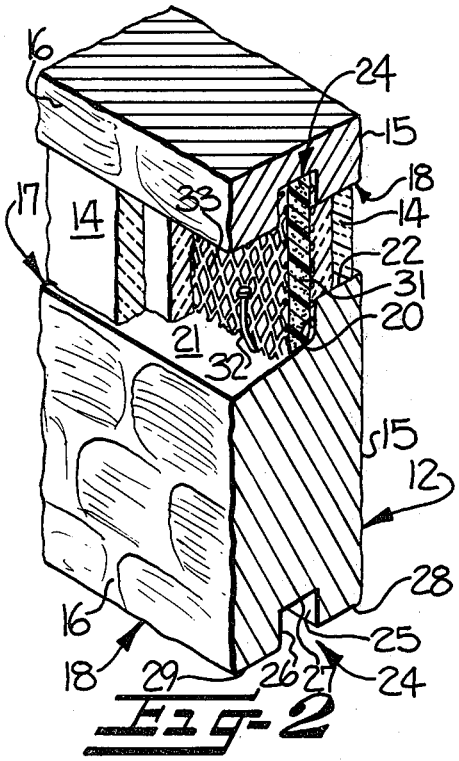
FIG. 2 is an exterior fragmentary perspective view showing the wall construction in greater detail.
Figure 3:
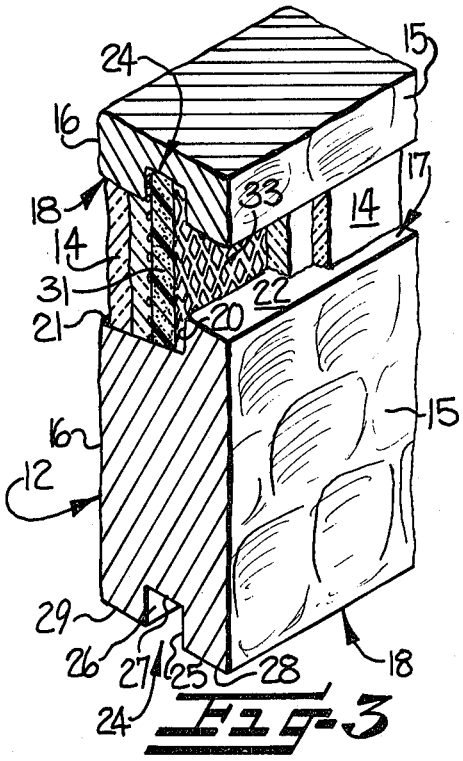
FIG. 3 is an interior fragmentary perspective view of the wall construction of FIG. 2.
Figure 4:
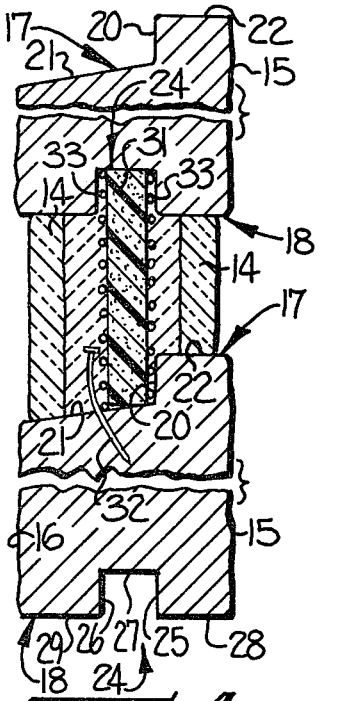
FIG. 4 is a cross-sectional view of the wall construction.

As more clearly seen in FIGS. 2 and 3, each log 12 is hand hewn into a generally squared configuration, and includes inner and outer generally flat sides, 15, 16 respectively, and upper and lower sides 17, 18 respectively. The upper side 17 of each log 12 includes a longitudinally extending, generally vertical abutment surface 20 located inwardly a predetermined distance from the outer side 16 of the log. The upper side 17 also includes an inclined surface portion 21 adjoining the lower end of the vertical abutment surface 20 and sloping downwardly and outwardly therefrom and adjoining the outer side 16 of the log. The upper side 17 also includes a generally flat surface portion 22 adjoining the upper end of the vertical abutment surface 20 and extending inwardly therefrom and adjoining the inner side 15 of the log.

The lower side 18 of each log 12 has a longitudinally extending notch 24 formed therein and located generally medially of the inner and outer sides 15, 16 of the log. Notch 24 is defined by opposing side walls 25, 26, with a generally flat bottom wall 27 extending therebetween. The lower side 18 of the log also includes generally flat surface portions 28, 29 respectively adjoining the side walls 25, 26 of the notch 24 and extending generally horizontally and adjoining the respective inner and outer sides 15, 16 of the log. The juncture between the outer side 16 and the adjoining flat surface portion 29 of the lower side 18 of the log defines a relatively sharp corner which serves to cause water to drip therefrom onto outermost portions of the next lower log, to thus reduce the opportunity for water to pass inwardly into the wall.

In order to fill the longitudinal spaces between adjacent logs 12, respective longitudinally extending filler panels 31 are located between the upper side 17 of each log and the lower side 18 of the next higher log. As illustrated, the upper end of each filler panel 31 is positioned in the notch 24, and the lower end of the filler panel is positioned tightly against the vertical abutment surface 20 on the upper side 17 of the log. The innermost side wall 25 of the notch 24 is located inwardly from the outer side 16 of the log the same distance as the vertical abutment surface 20 and serves as a corresponding abutment surface on the lower side of the log against which the filler panel 31 is abutted.

In the first embodiment of the invention, as is illustrated in FIGS. 1–4, the filler panel 31 is inserted from the outside of the wall and is held in place against the abutment surface 20 on the upper side of the log and the side wall 25 of notch 24 on the lower side of the log by suitable means, such as nails 32. As illustrated, the nails 32 are driven partially into the log and then bent inwardly against the outer side of the filler panel to hold the panel in place tightly against the abutment surface 20. The filler panel 31 is preferably formed of a foamed insulating material, such as Styrofoam. As illustrated, a lath material 33, formed of expanded metal, is provided over the inner and outer surfaces of the filler panel 31 to provide additional reinforcement and to serve as an anchor for the application of a hardenable filler material.

The joint is then sealed by a hardenable filler material or chinking 14 which is applied between the opposing upper and lower sides 17, 18 of adjacent logs and covering the outer side of the filler panel 31. In the embodiment illustrated, the filler material 14 is applied in two coats, including a base coat applied directly to the lath material 33, and a finish coat applied after the hardening of the base coat. However, the number of layers or coats of filler material 14 is not critical, and may be varied as desired. The filler material 14 may be formed of a hardenable cementitious material, such as mortar or masonry cement, or may comprise a hardenable elastic polymeric material, such as a hardenable urethane or silicone sealant material.

The inner side of the log wall 11 is similarly sealed by one or more coats of a hardenable filler material 14 applied over the inner surface of the filler panel 31 and between the opposing upper and lower sides of adjacent logs. The outer surface of the hardenable filler material 34 may be either flush with the adjoining surfaces of the logs, or if desired may be recessed therefrom a short distance.

It will thus be seen that the wall construction illustrated in FIGS. 1–4 provides a highly effective and durable airtight and watertight joint between adjacent logs which prevents the penetration of wind or water into or through the log wall. The ready accessibility of the vertical abutment surfaces from the exterior of the wall, due to the provision of the inclined surface portion 21 on the upper side of the wall allows the filler panels 31 to be installed a quick and economical manner. The filler panels 31 are of a height no greater than the vertical distance between the bottom wall 27 of the notch 24 and the inclined surface portion 21 of the next lower log to permit the filler panels 31 to be quickly and easily installed, and secured in place with the use of nails. The upper and lower end portions of the filler panel overlap and abut against the vertical abutment surface 20 and the inner side wall 25 of the notch 24 to provide a generous tolerance for variation in the precise height of the filler panel with respect to the vertical spacing between adjacent logs for ease of installation, while insuring that the longitudinal spaces between adjacent logs are completely filled by the filler panel. The insulating nature of the filler panel enhances the thermal insulating qualities of the wall. It will also be noted that the inclined surface portion 21 on the upper side of the log insures that any water which might seep into the wall is drained outwardly and does not have an opportunity to stand and contribute to rotting and decaying of the log.

Figure 5:
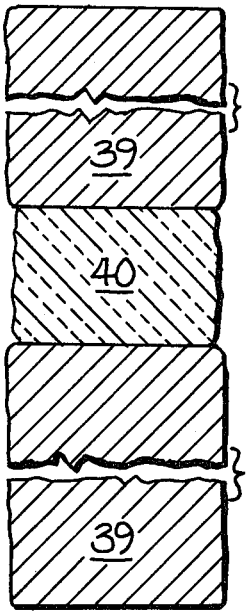
PRIOR ART Fig-5
FIGS. 5 and 6 are cross-sectional views showing log wall constructions in accordance with the prior art.

By contrast, FIG. 5 illustrates the manner in which the joints between adjacent logs were sealed in accordance with the practices followed by the early settlers. As illustrated, the spaces between adjacent logs 39 were merely filled with a hardenable chinking material 40, which was usually clay or mud or a mixture of such materials with rocks, gravel and/or straw. There was no provision for anchoring the chinking material 40 between the logs 39, and it will be seen that any shrinkage of the logs or chinking material or any movement of the wall would have a tendency to open up the joints between adjacent logs and allow water and wind to penetrate the wall.

Figure 6:
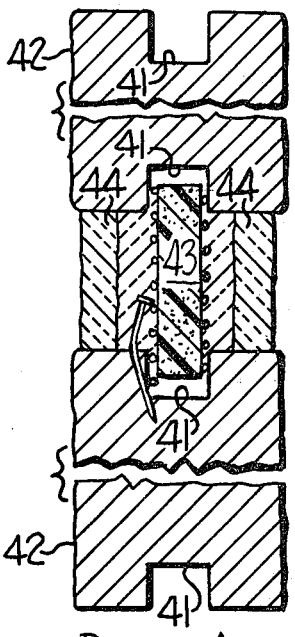
PRIOR ART Fig-6

FIG. 6 illustrates a log wall construction which has been previously utilized in contemporary log home construction, and over which the present invention is an improvement. As illustrated, notches 41 are formed in both the upper and lower sides of the logs 42, and a filler panel 43 is inserted first into one of the notches and then into the opposing notch between adjacent logs. The inner and outer sides of the filler panel are then covered with a hardenable filler material or chinking material 44 as previously described. One of the problems which has been experienced with this type of arrangement is that the height dimension of the filler panel 43 is critical. If the height dimension is too great, the filler panel is difficult, if not impossible, to insert between the logs 42. If on the other hand, the height dimension is too small, then a gap or crack is left in the joint between adjacent logs. Generally, it becomes necessary to custom trim each filler panel to the proper dimension in order to get it to fit into the grooves between adjacent logs. This is obviously undesirable and time consuming. Even then, a gap or opening is often left in the wall which must be filled by the filler material. Additionally, the groove in the upper side of the log has a tendency to collect any water which may seep into the wall, and to thus contribute to rotting and decaying of the log in this area. These problems are overcome by the construction of the present invention, wherein the upper side of the wall is provided with an inclined surface extending outwardly from the vertical abutment 20 to the outer side 15 of the log.

FIGS. 7–11 illustrate various modified forms of log building wall construction in accordance with the present invention. These various forms of wall construction are similar in many respects to the embodiment previously illustrated and described in detail in connection with FIGS. 1–4. The principal differences in these various forms or embodiments reside in the particular cross-sectional configuration of the logs. To avoid repetition, elements in the embodiments of FIGS. 7–11 which correspond to elements previously described in connection with FIGS. 1–4 will bear the same reference characters wherever applicable, with the letter suffix a–e added.

Figure 7:
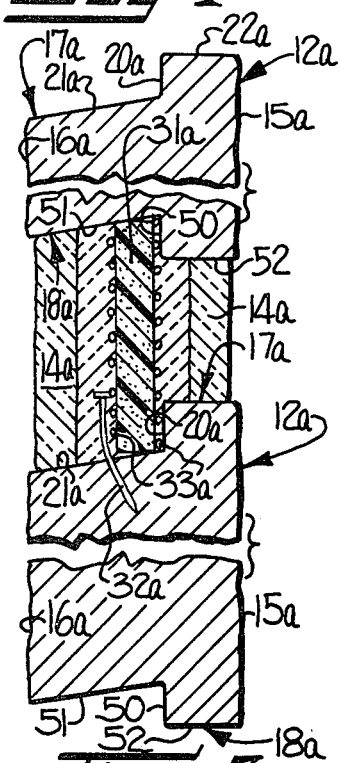
FIGS. 7–11 are cross-sectional views of a wall construction in accordance with various alternate forms of the invention.

Referring now more particularly to FIG. 7, it will be seen that this embodiment differs over that of FIGS. 1–4 in that the lower side **18*a* of the logs 12*a* have a cross-sectional configuration corresponding substantially to the upper sides 17*a*. Specifically, it will be noted that the lower sides of the logs include a longitudinally extending, generally vertical abutment surface 50 located a predetermined distance inwardly from the outer side 16*a* of the log and corresponding to the location of the vertical abutment surface 20*a* on the upper side of the log. An inclined surface portion 51 adjoins the upper end of the vertical abutment surface 50 and extends angularly downwardly therefrom and adjoins the outer side 16*a* of the log. A generally flat surface portion 52 adjoins the lowermost end of the vertical abutment surface 50 and extends generally horizontally inwardly therefrom and adjoins the inner side 16*a* of the log. The filler panels 31*a* and the hardenable filler material 14*a*** are located as in the previous embodiment.

Figure 8:
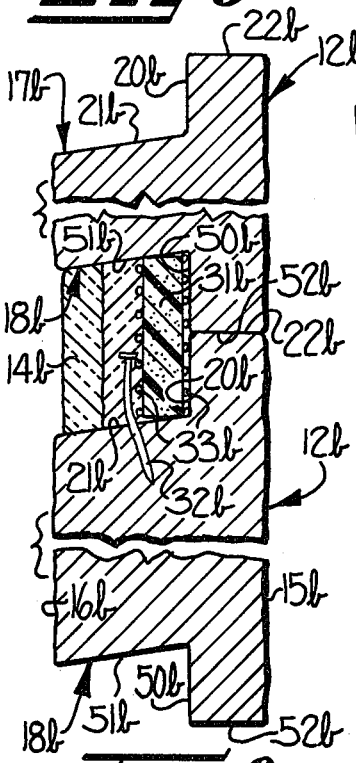

Referring now to FIG. 8, it will be seen that in this embodiment, the logs **12*b* have a cross-sectional configuration corresponding substantially to that of FIG. 7. This embodiment differs over that of FIG. 7 in that portions of the opposing upper and lower surfaces of adjacent logs are in contacting relation to one another. Specifically, the logs are arranged so that the flat surface portion 22*b* on the upper side of each log and the generally flat surface portion 52*b* on the lower side of each log are positioned in contacting relation. The space between the inclined surface portion 21*b* on the upper side of each log and the inclined surface portion 51*b* on the lower side of each log is filled with a filler panel 31*b* and a hardenable filler material 14*b*** as in the previous embodiments.

Figure 9:
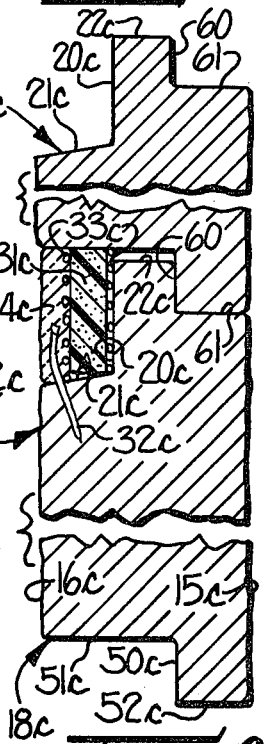

In the embodiment illustrated in FIG. 9, the logs **12*c* are also arranged in contacting relation with one another. The upper side 17*c* of each log 12*c* includes a longitudinally extending, generally vertical abutment surface 20*c* and an inclined surface portion 21*c* adjoining the lower end of the vertical abutment surface 20*c* and extending angularly downwardly therefrom and adjoining the outer side 16*c* of the log. A generally flat surface portion 22*c* adjoins the upper end of the vertical abutment surface 20*c* and extends inwardly therefrom a short distance. The upper side 17*c* of each log also includes an additional longitudinally extending, generally vertical surface 60 located inwardly from the vertical abutment surface 20*c*. The upper end of the vertical surface or shoulder 60 adjoins the flat surface portion 22*c*. A flat rear surface portion 61 adjoins the inner side 15*c* of the log and extends toward the outer side and adjoins the lower end of the vertical surface 60. The lower side 18*c* of each log includes a longitudinally extending, generally vertical abutment surface 50, a generally flat surface portion 51*c* adjoining the abutment surface 50*c* and extending outwardly therefrom to and adjoining the outer side 16*c* of the log, and a generally flat, longitudinally extending horizontal surface 52*c* adjoining the lower end of the vertical surface 50*c* and extending therefrom and adjoining the inner side 15*c* of the log. The logs are positioned one above another with the opposing surfaces 52*c* and 61 contacting one another, and with the filler panel 31*c* positioned against the vertical abutment surface 20*c* and secured in place by nails 32*c*. A hardenable filler material 14*c*** covers the outer exposed surface of the filler panel and provides an airtight and watertight seal between adjacent logs.

Figure 10:
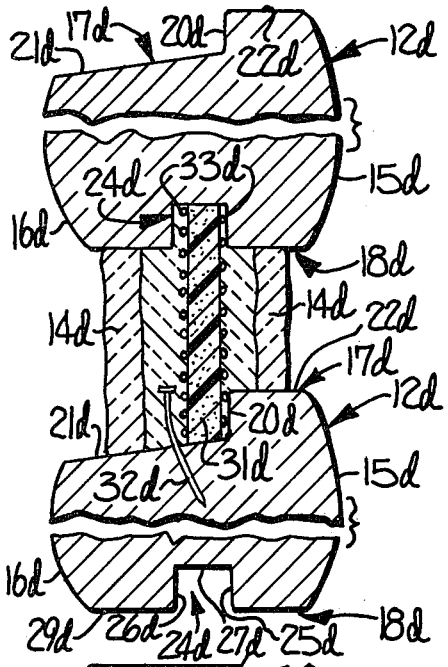

In the embodiment illustrated in FIG. 10, the upper and lower sides of the logs **12*d* have a configuration corresponding to that described in FIGS. 1–4. This embodiment differs over that a FIGS. 1–4 in tht the inner and outer sides 15*d*, 16*d*** respectively, are rounded rather than being of a flat, hewn configuration.

Figure 11:
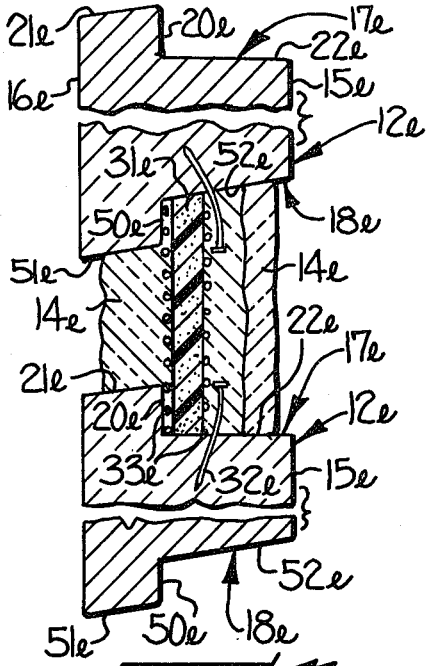

The embodiment illustrated in FIG. 11 differs over that of the previous embodiments primarily in that the filler panel **31*e* is inserted from the inside of the wall rather than from the outside. As illustrated, each log 12*e* has an upper side 17*e* including a longitudinally extending, generally vertical abutment surface 20***e*, and an inclined surface portion 21*e* adjoining the upper end of the vertical abutment surface 20*e* and extending angularly downwardly toward and adjoining the outer side 16*e* of the log. The upper side 17*e* also includes a generally flat surface portion 22*e* adjoining the lower end of the vertical abutment surface 20*e* and extending therefrom and adjoining the inner side 15*e* of the log.

The lower side 18*e* of each log includes a longitudinally extending, generally vertical abutment surface 50*e*, and an inclined generally flat surface portion 51*e* adjoining the lower end of the vertical abutment surface 50*e* and extending therefrom toward and adjoining the outer side 16*e* of the log. The lower side 18*e* also includes a generally flat surface portion 52*e* adjoining the upper end of the vertical abutment surface 50*e* and extending therefrom and adjoining the inner side 15*e* of the log. The filler panels 31*e* are installed from the interior side of the wall and are positioned tightly against the vertical abutment surfaces 20*e*, 50*e* respectively, and are held in place by nails 32*e*. A hardenable filler material 14*e* is then applied between the upper and lower sides of the logs covering the inner and outer exposed surfaces of the filler panels 31*e*.

Figure 12:
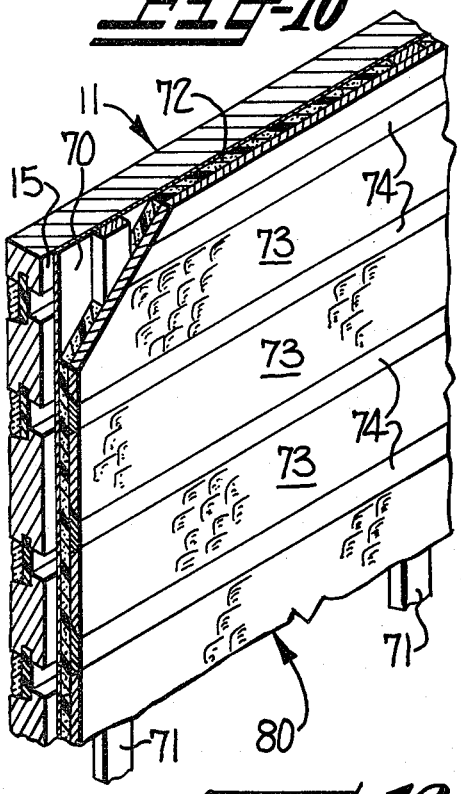
FIG. 12 is an interior fragmentary perspective view of a wall construction in accordance with this invention having an additional insulated interior wall overlying the interior surface of the log wall and simulating the appearance of a log wall.
Figure 13:
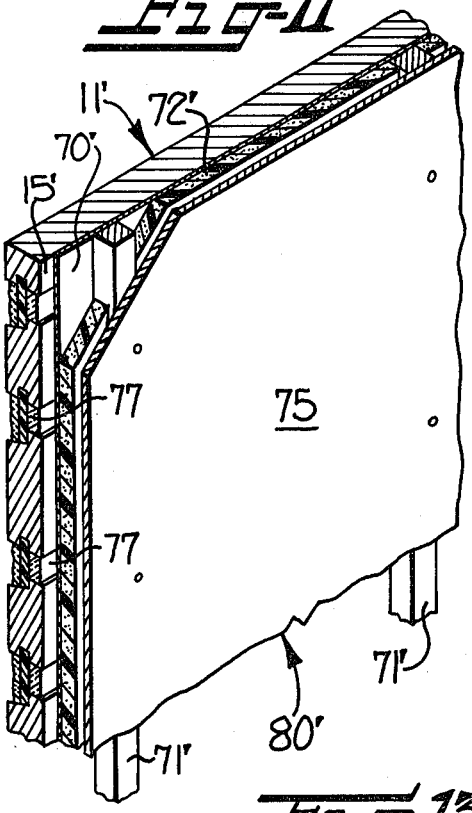
FIG. 13 is a view similar to FIG. 12 but wherein the interior wall is formed of wallboard.

In the modified embodiments of the invention illustrated in FIGS. 12 and 13, the log walls 11 of this invention have been provided with means defining an insulated finished, interior wall, indicated at 80, overlying the inner sides 15 of the logs. In the embodiment of FIG. 12, the insulated finished interior wall 80 is designed so as to simulate the appearance of a log wall, whereas in the embodiment of FIG. 13 the finished interior wall 80' has a plain surface. The construction of the log wall 11 is as described in connection with FIGS. 1–4.

Referring more closely to FIG. 12, it will be seen that the inner sides 15 of the logs 12 have been covered first with a vapor barrier 70 comprised of building felt or plastic. Overlying the vapor barrier layer 70 are a series of vertically extending, laterally spaced apart furring strips 71 which are secured to the inner sides 15 of the logs by nails or other suitable means. Between the furring strips 71 is positioned an insulation material 72, such as Styrofoam. A series of horizontally extending planks 73 having a roughened or textured surface simulating the appearance of hand hewn logs are secured to the furring strips 71 by nails or other suitable means. As illustrated, the upper and lower edges of the planks 73 are beveled, and the upper and lower edges of adjacent planks are spaced vertically apart from one another. A hardenable filler material or chinking 74 is applied between the adjacent planks 73. This arrangement results in an interior wall which simulates the appearance of the inner side of a log building wall. However, the insulating value of this wall is significantly increased by this arrangement. It will be noted that the hardenable filler material 34 has been omitted from the inner side of the filler panels 31 to thus leave longitudinally extending voids or dead air spaces between the filler panel 34 and the overlying insulated finished interior wall 80.

The embodiment shown in FIG. 13 is quite similar to that of FIG. 12 and to avoid repetition, elements in FIG. 13 which correspond to those previously described in FIG. 12 will bear the same reference characters, with prime notation added. The basic difference in this embodiment over FIG. 12 is that the inner surface of the wall 80' is formed by panels 75 of wallboard, wood paneling, or other suitable material. Additionally, to provide additional insulating value in the wall, insulation material 77 has been provided in the longitudinally extending spaces between the inner side of the filler panels 34 and the overlying wall.

In the drawings and specification, there have been set forth preferred embodiments of the invention, and although specific terms are employed, they are used in a generic and descriptive sense only and not for purposes of limitation.

What is claimed is:

1. A building wall comprising a plurality of logs arranged generally parallel, one above another, said logs having respective inner and outer sides and respective upper and lower sides positioned in opposing relation to the adjacent upper and lower sides of other logs, the upper side of each of said logs including a longitudinally extending generally vertical abutment surface located between the inner and outer sides of the log and a longitudinally extending inclined surface portion adjoining said abutment surface and sloping continuously downwardly therefrom toward and adjoining the outer side of said log, respective longitudinally extending filler panels located between the upper side of each log and the lower side of the next higher log and positioned against said vertically extending abutment surface on the upper side of the log for substantially filling any longitudinal spaces between adjacent logs, and a hardenable filler material located between the upper side of each log and the lower side of the next higher log and covering the outer side of said filler panel located therebetween to provide a seal between adjacent logs to prevent the passage of water and air through said wall.

2. A building wall as set forth in claim 1 wherein said logs are of a generally squared cross section and of varying height.

3. A building wall as set forth in claim 1 wherein said logs have generally rounded outer and inner sides.

4. A building wall as set forth in claim 1 wherein said logs are arranged with their upper and lower sides in spaced apart noncontacting relationship.

5. A building wall as set forth in claim 1 wherein said logs are arranged with portions of their upper and lower sides in contacting relationship.

6. A building wall as set forth in claim 1 wherein the lower side of each of said logs also includes a longitudinally extending generally vertical abutment surface located between the inner and outer sides of the log, and wherein said respective filler panels located between the upper side of each log and the lower side of the next higher log are also positioned against said vertical abutment surface on the lower side of the log.

7. A building wall as set forth in claim 6 including means cooperating with said filler panels for securing the filler panels in place tightly against said vertical abutment surfaces on the upper and lower sides of said logs.

8. A building wall as set forth in claim 7 wherein said filler panels are formed of a foamed insulating material, and said means for securing the filler panels in place comprise nails extending into the logs and engaging said filler panels.

9. A building wall as set forth in claim 6 wherein the lower side of each of said logs has a longitudinally extending notch formed therein and wherein said generally vertical abutment surface on the lower side of the log is defined by one of the side walls of said notch.

10. A building wall as set forth in claim 6 wherein the lower side of each of said logs has a longitudinally extending inclined surface portion adjoining the upper end of said vertical abutment surface and sloping downwardly therefrom toward and adjoining the outer side of said log.

11. A building wall as set forth in claim 1 additinally comprising a lath material overlying the outer surface of said filler panel for anchoring said hardenable filler material in place.

12. A building wall as set forth in claim 1 wherein the juncture between the outer and lower sides of each of said logs is defined by a relatively sharp corner serving to cause water to drip therefrom onto outermost portions of the next lower log without passing inwardly through the wall.

13. A building wall as set forth in claim 1 additionally comprising a hardenable filler material located between the upper side of each log and the lower side of the next higher log and covering the inner side of said filler panel located therebetween.

14. A building wall as set forth in claim 1 additionally including means defining an insulated finished interior wall overlying said inner sides of said parallel arranged logs, and wherein the inner sides of said respective longitudinally extending filler panels are recessed from the inner sides of said logs to form respective longitudinally extending dead air spaces within said building wall.

15. A building wall as set forth in claim 14 wherein said means defining an insulated finished interior wall comprises a plurality of spaced apart furring strips extending across and connected to said inner sides of said logs, insulation positioned between said furring strips, and covering said inner sides of said logs, and panel means overlying said furring strips and said insulation.

16. A building wall as set forth in claim 1 wherein the longitudinally extending inclined surface portion on the upper side of each log adjoins the lower end of said vertically extending abutment surface on the upper side of the log and slopes downwardly therefrom and adjoins the outer side of said log, and the upper side of said log also includes a surface portion adjoining the upper end of said vertically extending abutment surface and adjoining the inner side of said log.

17. A building wall as set forth in claim 1 wherein the longitudinally extending inclined surface portion on the upper side of each log adjoins the upper end of said vertically extending abutment surface on the upper side of the log and slopes downwardly therefrom and adjoins the outer side of said log, and the upper side of said log also includes a generally flat surface portion adjoining the lower end of said vertically extending abutment surface and extending therefrom and adjoining the inner side of said log.

18. A building wall comprising a plurality of logs arranged generally parallel, one above another in spaced apart relation, said logs having respective inner and outer sides and respective upper and lower sides positioned in opposing relation to the adjacent upper and lower sides of other logs, the upper side of each of said logs including a longitudinally extending generally vertical abutment surface located between the inner and outer sides of the log and a longitudinally extending inclined surface portion adjoining the lower end of said vertical abutment surface and sloping continuously downwardly therefrom toward and adjoining the outer side of said log, the lower side of each of said logs also including a longitudinally extending generally vertical abutment surface located between the inner and outer sides of the log, respective longitudinally extending filler panels located between the upper side of each log and the lower side of the next higher log and positioned against said vertical abutment surfaces on the upper and lower sides of said logs for substantially filling the longitudinal spaces between adjacent spaced apart logs, and a hardenable filler material located between the upper side of each log and the lower side of the next higher log and covering the outer side of said filler panel located therebetween to provide a seal between adjacent logs to prevent the passage of water and air through said wall.

19. A building wall as set forth in claim 18 wherein the upper side of each of said logs includes a longitudinally extending generally flat surface portion adjoining the upper end of said vertical abutment surface and extending generally horizontally inwardly therefrom and adjoining the inner side of said log.

20. A building wall as set forth in claim 18 wherein said longitudinally extending generally vertical abutment surfaces on the upper and lower sides of said logs are disposed in a common vertical plane and located closer to the inner side of the log than to the outer side thereof.

21. A building wall comprising a plurality of logs of a generally squared cross sectional configuration arranged generally parallel, one above another, said logs having respective inner and outer sides and respective upper and lower sides positioned in opposing relation to the adjacent upper and lower sides of other logs; the upper side of each of said logs including a longitudinally extending generally vertical abutment surface located a predetermined distance inwardly from the outer side of the log and closer to the inner side, a longitudinally extending laterally inclined surface portion adjoining the lower end of said vertical abutment surface and sloping downwardly therefrom toward and adjoining the outer side of said log, and a longitudinally extending generally flat surface portion adjoining the upper end of said vertical abutment surface and extending inwardly therefrom and adjoining the inner side of said log; the lower side of each of said logs also including a longitudinally extending generally vertical abutment surface located a predetermined distance inwardly from the outer side of the log and corresponding to the location of said abutment surface on the upper side of the log; respective longitudinally extending filler panels located between the upper side of each log and the lower side of the next higher log and positioned against said vertical abutment surfaces on the upper and lower sides of said logs for substantially filling any longitudinal spaces between adjacent logs, means cooperating with said filler panels for securing the filler panels in place tightly against said vertical abutment surfaces on the upper and lower sides of said logs; and a hardenable filler material located between the upper side of each log and the lower side of the next higher log and covering the outer side of said filler panel located therebetween to provide a seal between adjacent logs to prevent the passage of water and air through said wall.

22. A building wall as set forth in claim 21 wherein the lower side of each of said logs has a longitudinally extending notch formed therein, and wherein said generally vertical abutment surface on the lower side of the log is defined by one of the side walls of said notch, and wherein the juncture of said outer side with said lower side of each of said logs is defined by a relatively sharp corner serving to cause water to drip therefrom onto outermost portions of the next lower log without passing inwardly through the wall.

23. A building wall comprising a plurality of logs arranged generally parallel, one above another in spaced apart relation, said logs have respective inner and outer sides and respective upper and lower sides positioned in opposing relation to the adjacent upper and lower sides of other logs, the upper side of each of said logs including a longitudinally extending generally vertical abutment surface located between the inner and outer sides of the log and a longitudinally extending surface portion adjoining the lower end of said vertical abutment surface and extending laterally outwardly therefrom toward and adjoining the outer side of said log, the lower side of each of said logs also including a longitudinally extending generally vertical abutment surface located between the inner and outer sides of the log, respective longitudinally extending filler panels located between the upper side of each log and the lower side of the next higher log and positioned against said vertical abutment surfaces on the upper and lower sides of said logs for substantially filling the longitudinal spaces between adjacent spaced apart logs, and a hardenable filler material located between the upper side of each log and the lower side of the next higher log and covering the outer side of said filler panel located therebetween to provide a seal between adjacent logs to prevent the passage of water and air through said wall.

24. A building wall comprising a plurality of logs of a generally squared cross-sectional configuration arranged generally parallel, one above another in spaced apart relation, said logs having respective inner and outer sides and respective upper and lower sides positioned in opposing relation to the adjacent upper and lower sides of other logs, the upper side of each of said logs including a longitudinally extending generally vertical abutment surface located between the inner and outer sides of the log and a longitudinally extending surface portion adjoining the lower end of said vertical abutment surface and extending laterally outwardly therefrom toward and adjoining the outer side of said log, the lower side of each of said logs having a longitudinally extending notch formed therein and defining a longitudinally extending generally vertical abutment surface located between the inner and outer sides of the log, respective longitudinally extending filler panels located between the upper side of each log and the lower side of the next higher log and positioned against said vertical abutment surfaces on the upper and lower sides of said logs for substantially filling the longitudinal spaces between adjacent spaced apart logs, and a hardenable filler material located between the upper side of each log and the lower side of the next higher log and covering the outer side of said filler panel located therebetween to provide a seal between adjacent logs to prevent the passage of water and air through said wall.

* * * * *